United States Patent [19]

Deveau et al.

[11] Patent Number: 4,513,567

[45] Date of Patent: Apr. 30, 1985

[54] GAS TURBINE ENGINE ACTIVE CLEARANCE CONTROL

[75] Inventors: Paul J. Deveau, Ellington; Paul B. Greenberg, Manchester; Roger E. Paolillo, Vernon, all of Conn.

[73] Assignee: United Technologies Corporation, Hartford, Conn.

[21] Appl. No.: 576,770

[22] Filed: Feb. 3, 1984

Related U.S. Application Data

[63] Continuation of Ser. No. 317,633, Nov. 2, 1981, abandoned.

[51] Int. Cl.[3] ..... F02G 3/00; F01D 11/08

[52] U.S. Cl. ..... 60/39.02; 415/178

[58] Field of Search ..... 60/39.02, 39.07; 415/116, 117, 175, 178, 115

[56] References Cited

U.S. PATENT DOCUMENTS

| | | | |
|---|---|---|---|
| 3,039,737 | 6/1962 | Kolthoff | 415/17 |
| 3,911,354 | 10/1975 | Stanton | 236/75 |
| 3,914,952 | 10/1975 | Barbier | 236/75 |
| 3,957,391 | 5/1976 | Vollinger | 415/116 |
| 3,966,354 | 6/1976 | Patterson | 415/116 |
| 3,975,112 | 8/1976 | Brown et al. | 415/116 |
| 3,975,901 | 8/1976 | Hallinger et al. | 60/39.141 |
| 4,005,946 | 2/1977 | Brown et al. | 415/136 |
| 4,019,320 | 4/1977 | Redinger et al. | 60/39.75 |
| 4,069,662 | 1/1978 | Redinger et al. | 60/226.1 |
| 4,213,296 | 7/1980 | Schwarz | 60/39.141 |
| 4,230,436 | 10/1980 | Davison | 415/1 |
| 4,242,042 | 12/1980 | Schwarz | 415/116 |
| 4,279,123 | 7/1981 | Griffin et al. | 60/226.1 |
| 4,304,093 | 12/1981 | Schulze | 60/39.07 |
| 4,317,646 | 3/1982 | Steel et al. | 415/178 |

*Primary Examiner*—Louis J. Casaregola
*Assistant Examiner*—Timothy S. Thorpe
*Attorney, Agent, or Firm*—Norman Friedland; Robert C. Walker

[57] ABSTRACT

Method for controlling the clearance between rotating and stationary components of a gas turbine engine are disclosed. Techniques for achieving close correspondence between the radial position of rotor blade tips and the circumscribing outer air seals are disclosed. In one embodiment turbine case temperature modifying air is provided in flow rate, pressure and temperature varied as a function of engine operating condition. The modifying air is scheduled from a modulating and mixing valve supplied with dual source compressor air. One source supplies relatively low pressure, low temperature air and the other source supplies relatively high pressure, high temperature air. After the air has been used for the active clearance control (cooling the high pressure turbine case) it is then used for cooling the structure that supports the outer air seal and other high pressure turbine component parts.

1 Claim, 5 Drawing Figures

GAS TURBINE ENGINE ACTIVE CLEARANCE CONTROL

The invention described herein was made in the performance of work under NASA Contract No. NAS3-20646 and is subject to the provisions of Section 305 of the National Aeronautics and Space Act of 1958 (72 Stat. 435; 42 U.S.C. 2457).

CROSS REFERENCE TO RELATED APPLICATION

This is a continuation of application Ser. No. 317,633, filed on Nov. 2, 1981, now abandoned.

TECHNICAL FIELD

This invention relates to gas turbine engines, and more specifically to the active control of clearances between opposing seal elements of the rotor and stator assemblies.

BACKGROUND ART

It is well known in the gas turbine industry that engine performance is proportional to the leakage of working medium gases between opposing seal elements of the rotor and stator assemblies. Techniques and concepts for reducing such clearances are continually under investigation and development.

One class of techniques are those relating to "active clearance control" in which the clearances are set as a function of engine operating condition. The objective is to establish minimum clearances under stable operating conditions, yet to provide sufficient clearance during transient operation to preclude destructive interference between relatively rotating components.

U.S. Pat. Nos. 3,039,737 to Kolthoff entitled "Device for Controlling Clearance Between Rotor and Shroud of a Turbine"; 3,966,354 to Patterson entitled "Thermal Actuated Valve for Clearance Control"; 3,975,901 to Hollinger et al entitled "Device for Regulating Turbine Blade Tip Clearance"; and 4,213,296 to Schwarz entitled "Seal Clearance Control System for a Gas Turbine" are representative of concepts and structures for effecting local control over rotor blade tip clearances. In some embodiments relatively hot air is utilized to move the seals away from the rotor blade tips and in other embodiments relatively cool air is utilized to move the seals toward the rotor blade tips. The concepts are at times combined in the same structure.

Recent commercial aircraft gas turbine engines, such as the JT9D-7R4 engine manufactured by Pratt & Whitney Aircraft, Division of United Technologies Corporation, have incorporated clearance control systems operative on a large segment of the engine to closely match thermal growth of the stator elements to that of the rotor elements. Principally, cooling or heating air is squirted onto the exterior of the engine case of the segment to be controlled. Desired contraction or expansion occurs. U.S. Pat. Nos. 4,069,662 to Redinger et al entitled "Clearance Control for Gas Turbine Engine"; 4,019,320 to Redinger et al entitled "External Gas Turbine Engine Cooling for Clearance Control"; and 4,279,123 to Griffin et al entitled "External Gas Turbine Engine Cooling for Clearance Control" are representative of the concepts employed in systems of the external type.

Advancing techniques for effecting segment cooling now include the wide distribution of cooling air at the interior of the case. Cooling air is flowed along the interior of the engine between the working medium flow path and the engine case.

U.S. Pat. Nos. 3,957,391 to Vollinger entitled "Turbine Cooling"; 3,975,112 to Brown et al entitled "Apparatus for Sealing Gas Turbine Flow Path"; 4,005,946 to Brown et al entitled "Method and Apparatus for Controlling Stator Thermal Growth"; and 4,242,042 to Schwarz entitled "Temperature Control of Engine Case for Clearance Control" representatively illustrated such concepts.

Notwithstanding the effectiveness of such prior art systems, scientists and engineers in the gas turbine engine industry are seeking yet improved systems employing judicious use of cooling/heating air.

DISCLOSURE OF THE INVENTION

According to the present invention the flow rate and temperature of turbine case, temperature modifying air in an active clearance control system is varied by modulating proportions of relatively low temperature, low pressure air and relatively high temperature, high pressure air in response to engine operating conditions.

In accordance with one detailed embodiment of the invention the case temperature modifying air is flowable to one or more annular spaces circumscribing the cases to be controlled, and thence internally of the cases for cooling of components in proximity to the engine flow path.

A primary feature of the present invention is the utilization of dual source air for modifying the temperature of the engine case. Relatively low pressure, low temperature compressor air is mixed with relatively high temperature high pressure air at one or more modulating valves. The valves are capable of varying the proportions of air from each source for effecting case cooling at differing flow rates and temperatures.

In one detailed embodiment a shroud circumscribes each engine case to be controlled and is spaced apart therefrom. Case temperature modifying air is flowable to the space. The modifying air is subsequently flowable through apertures in the case into the interior of the engine for cooling components adjacent the engine flow path.

A principal advantage of the present invention is the judicious use of case temperature modifying air for controlling case diameter. Internal clearances at seals between rotor and stator structure are minimized by matching the case diameter to expected rotor growth under varied engine operation conditions. As viewed from another aspect, turbine cooling air utilized to protect engine components adjacent the flow path is diverted en route to preliminarily modify the temperature of the engine case. Improved engine performance results from the sequential use of compressor air for such auxiliary purposes as well as from actual clearance control.

The foregoing features and advantages of the present invention will become more apparent in the light of the following detailed description of the best mode for carrying out the invention and in the accompanying drawing.

BEST MODE FOR CARRYING OUT THE INVENTION

Figure 1:
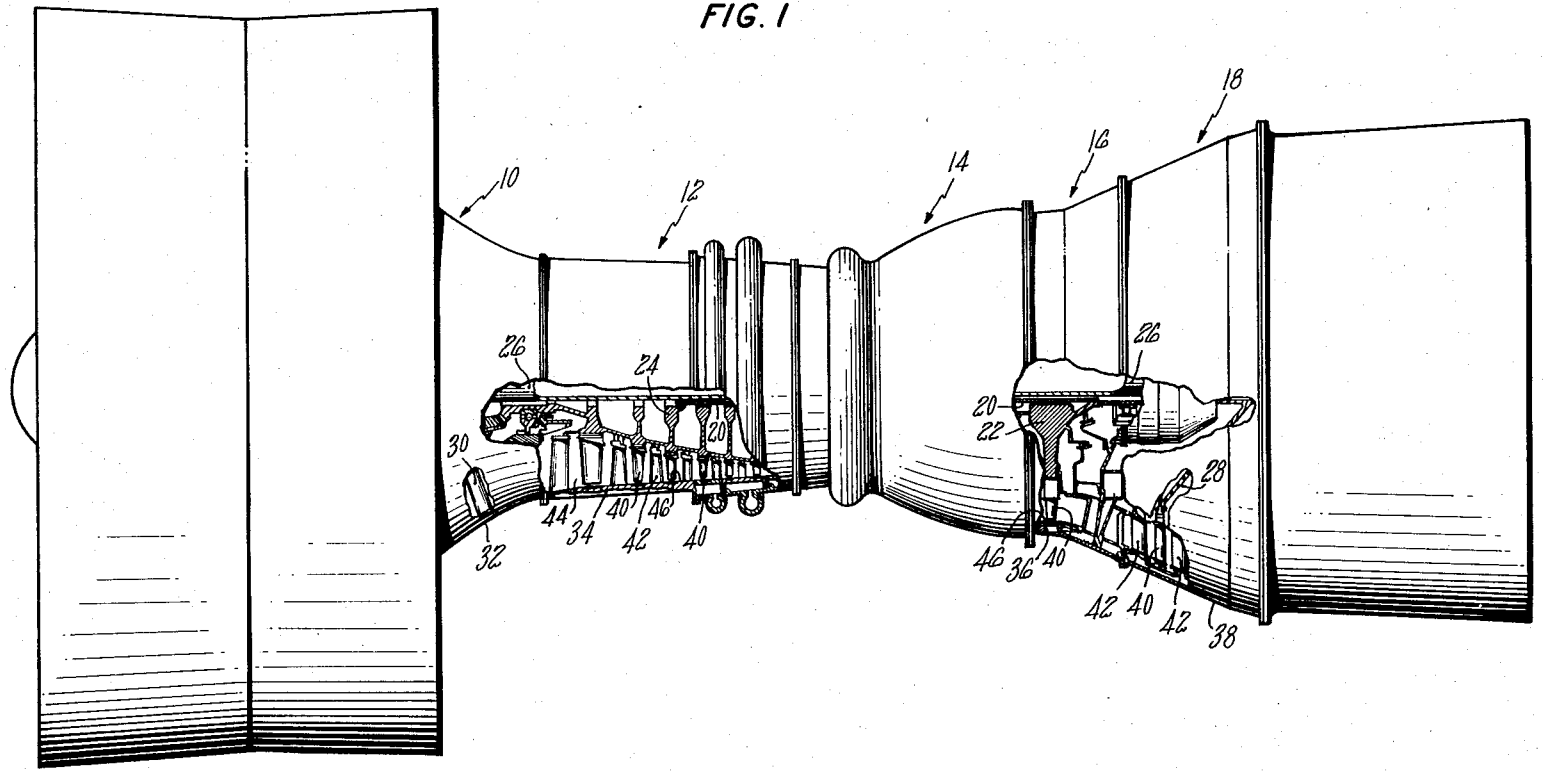
FIG. 1 is a simplified side elevation view of a gas turbine engine with portions broken away in cross section.

An aircraft-type gas turbine engine capable of employing the concepts of the present invention is illustrated in the FIG. 1 partial cross section view. The engine principally includes a low pressure compression section 10, a high pressure compression section 12, a combustion section 14, a high pressure turbine section 16 and a low pressure turbine section 18. The engine illustrated is of the dual rotor type having a first shaft 20 joining a high turbine rotor assembly 22 to a high compressor rotor assembly 24 and a second shaft 26 joining a low turbine rotor assembly 28 to a low compressor rotor assembly 30.

The respective rotor assemblies are contained within a low compressor case 32, a high compressor case 34, a high turbine case 36 and a low turbine case 38. Rows of rotor blades, as represented by the single blades 40 extend outwardly on the rotor blades toward the engine cases. Rows of stator vanes, as represented by the single vanes 42, are supported from the engine cases and extend inwardly therefrom in interdigitated position with respect to the blades 40. A flow path 44 from working medium gases extends axially through the engine between rows of rotor blades and rows of stator vanes.

Figure 4:
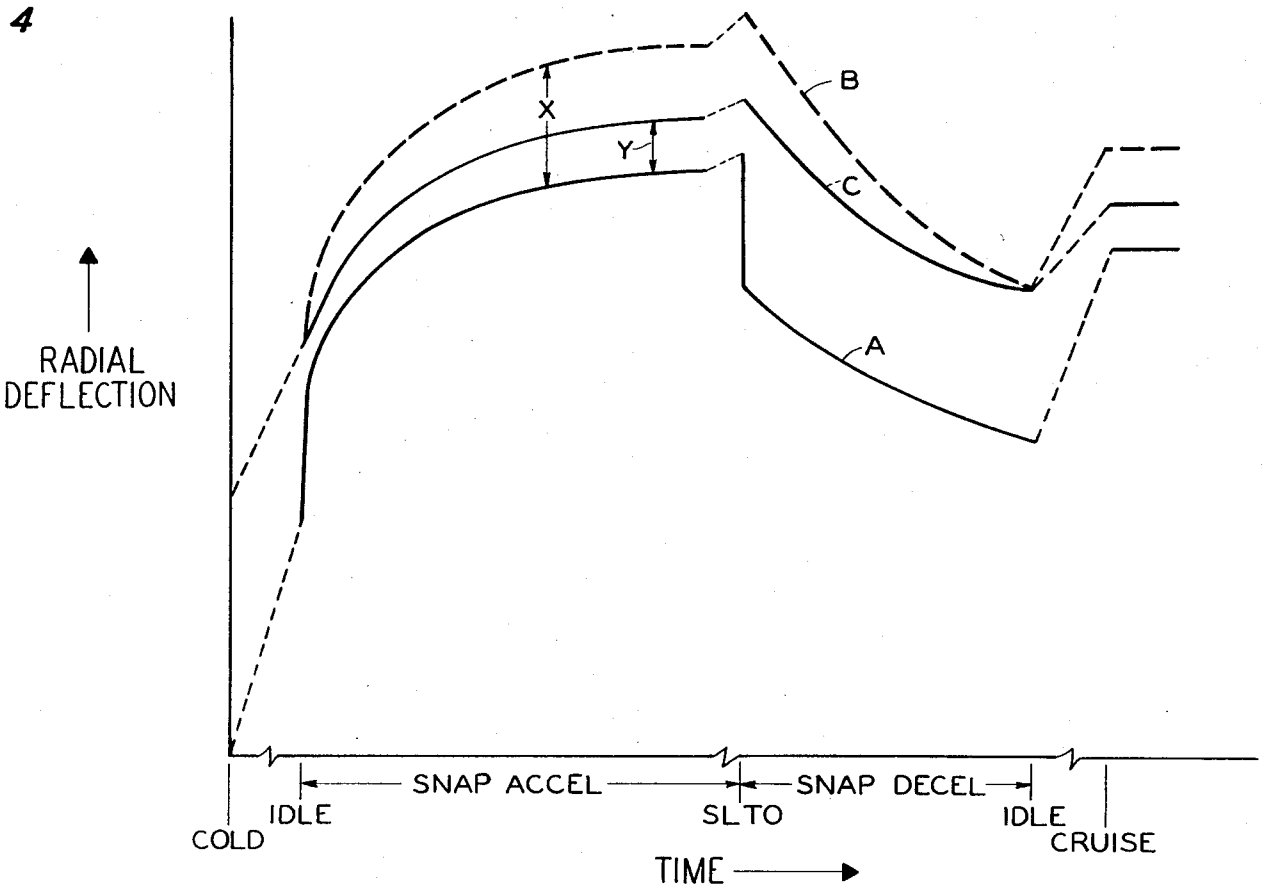
FIG. 4 is a "pinch point" diagram illustrating relative thermal growth between the rotor and stator of such an engine.

The rows of rotor blades 40 are circumscribed by essentially cylindrical outer air seals 46. The positions of the outer air seals relative to the tips of the rotor blades is largely a function of the diameter of the engine case supporting the seals and of the temperature of the rotor blades. Particularly, within the turbine section the relative positions, referred to as "clearance" may vary widely over the operating range of the engine as the rotor blades and the case are subjected to differing thermal environments. Curve A of FIG. 4 represents the radial position of the rotor blade tips at a turbine section location as a function of engine operating condition. Curve B of FIG. 4 represents the radial position of the outer air seal at the corresponding turbine location as a function of engine operating condition. The gap X between the two curves illustrates the expected clearance between the two relatively rotating components in an engine not employing the active clearance control concepts to be later described.

Figure 2:
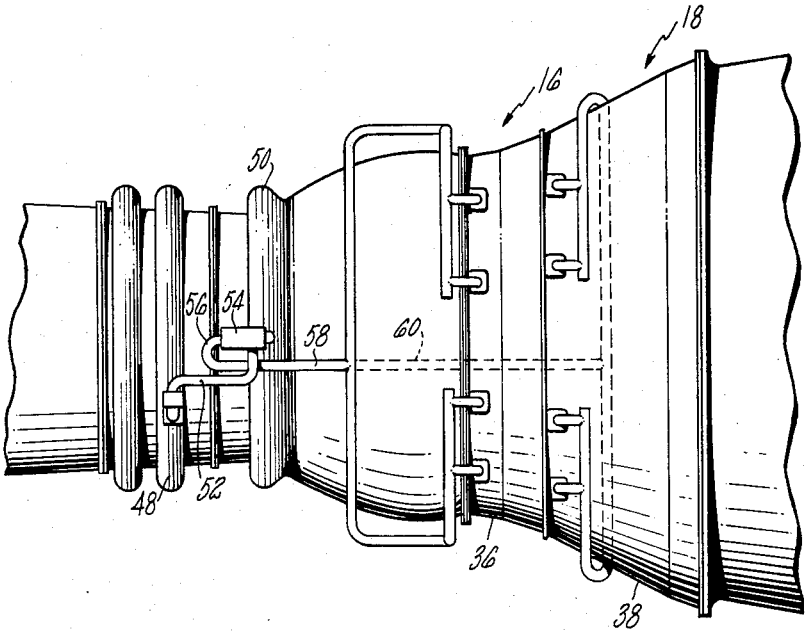
FIG. 2 is a simplified side elevation view of a portion of the engine illustrating the dual course of turbine case, temperature modifying air.

The simplified side elevation view of FIG. 2 illustrates apparatus incorporating the concepts of the present invention. A first manifold 48 is in gas communication with the compressor at a relatively low pressure, low temperature stage. A second manifold 50 is in gas communication with the compressor at a relatively high pressure, high temperature stage such as downstream of the final compression stage. A low pressure conduit 52 connects the manifold 48 with a modulating and mixing valve 54; a high pressure conduit 56 connects the manifold 50 to the valve 54.

The modulating and mixing valve 54 is capable for receiving the dual source air from the compressor and modulating the flow of each to produce an effluent having a desired temperature, pressure, and flow rate. In some embodiments the valve may be collaterally capable of producing dual effluents, each having individualized temperatures, pressures and flow rates. Effluent from the valve is flowed to the turbine section of the engine through one or more conduits 58. In the structure illustrated a second modulating and mixing valve on the reverse side of the engine is capable of discharging effluent through a second conduit 60 to a downstream position on the turbine. The first conduit 58 illustrated is capable of discharging to the high pressure turbine 16; the second conduit 60 illustrated is capable of discharging to the low pressure turbine 18.

Figure 3:
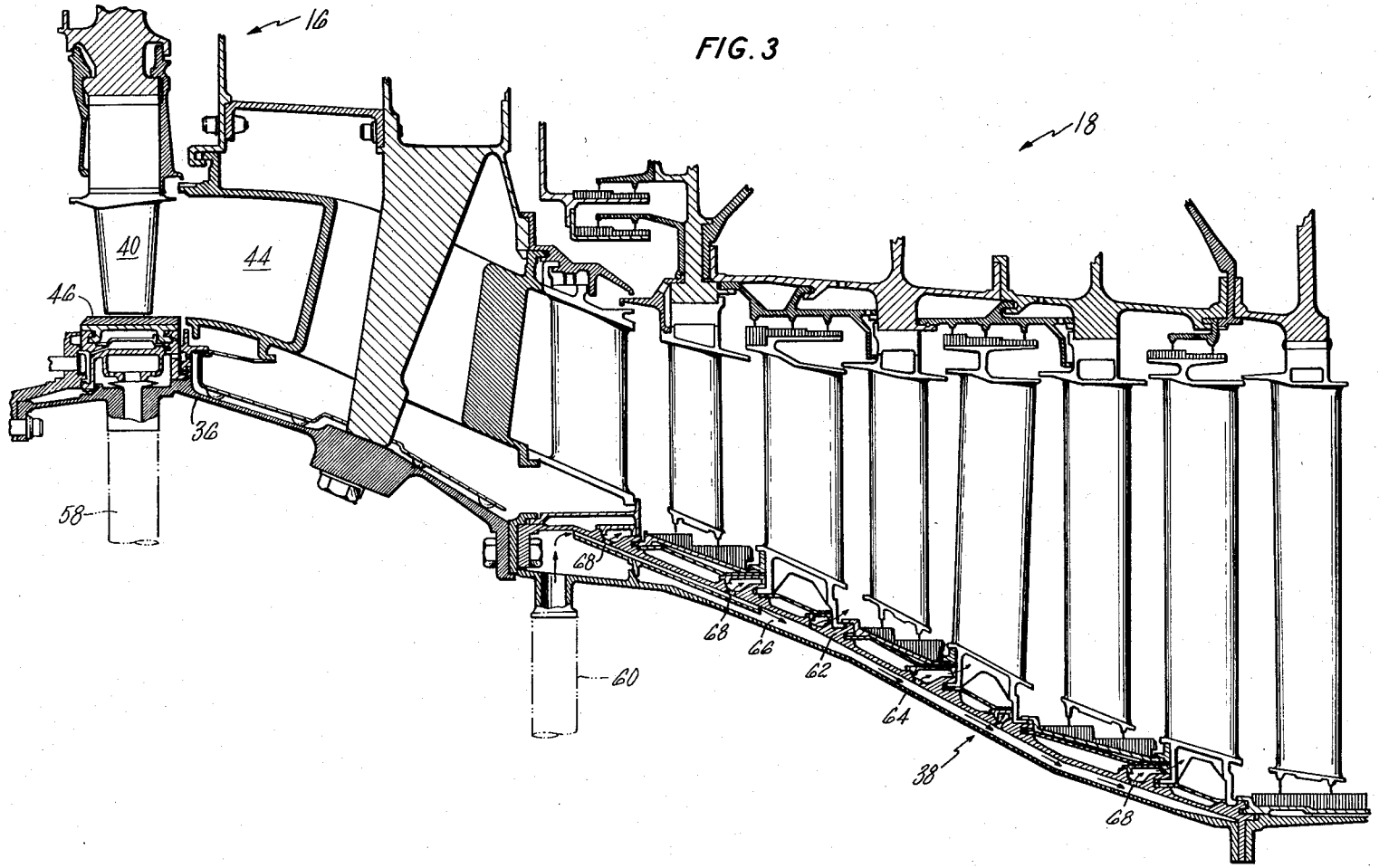
FIG. 3 is a simplified view of a portion of the turbine section of the engine illustrating the distribution of cooling air internally of the engine.

The FIG. 3 turbine cross section view illustrates the distribution of effluent from the modulating and mixing valves via the first conduit 58 to the high pressure turbine 16 and via the second conduit 60 to the low pressure turbine 18.

Figure 5:
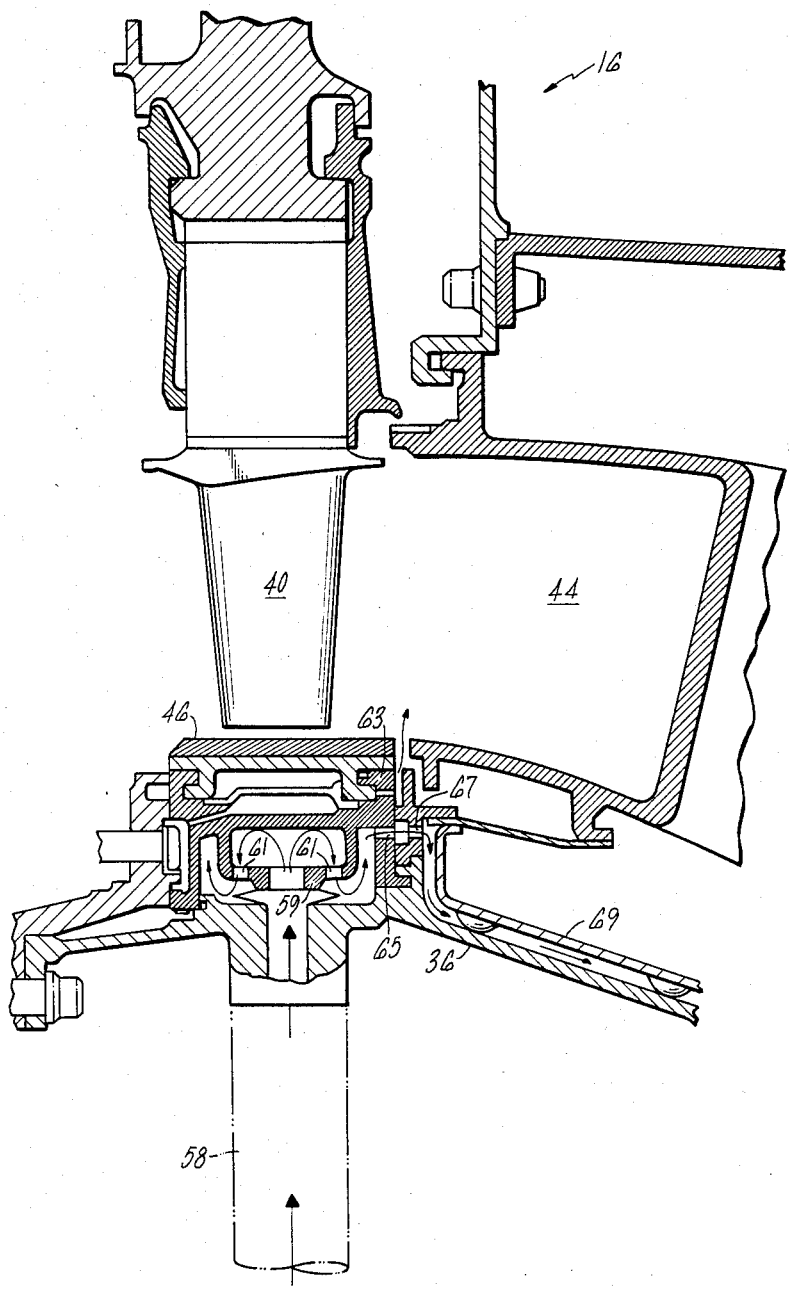
FIG. 5 is a partial view and an enlargement of the high pressure turbine section depicted in FIG. 3 to show the flow pattern of this invention.

To illustrate the flow characteristics of this invention at the high pressure turbine, the structure of the high pressure turbine disclosed in FIG. 3 is enlarged in FIG. 5. As noted, the modulated air is conducted through conduit 58 where it is admitted into the manifold 59 which are segmented around the periphery of the row of high pressure turbine blades 40. The air is transmitted through a plurality of apertures where it is directed to impinge on the high pressure turbine case 36. The air is then directed inwardly toward the engine centerline where it serves to cool the structure of manifold 59 and the supporter hooks 63 and the attendant structure. A portion of this air leaks between the adjacent supporting structure and then into the engine air stream downstream of the high pressure turbine blades 40 while the remaining air is directed downstream through openings 65 and 67 in the support structure and then between the shield 69 and the inner diameter of the high pressure turbine case 36 where it dumps into the low pressure turbine section downstream thereof.

In this manner, and as is apparent from the foregoing, the air utilized to control the gap between the outer air seal 46 and the tips of the high pressure turbine blades 40 is also used to cool the supporting structure. This negates the need to bring in air from a separate source to cool these components as was done in the heretofore systems. Consequently, this avoids putting an undue thermal stress on the high pressure turbine case that would otherwise occur by having air from two different sources where one source may be cooler than the other and hence create a situation where considerably hotter air is opposite the cooler impinging air and impairing its intended function of shrinking the case to close the gap or vice versa. In the low turbine the case 38 is formed of double wall construction including an inner case 62 and an outer case or shroud 64. Effluent from the modulating and mixing valve is flowable to a space 66 between the inner case and shroud for the purpose of modifying the temperature of the case as a function of engine operating condition. The modifying air is hence flowable through apertures 68 in the inner case to the interior of the engine for subsequently cooling engine components in the turbine.

During operation of the engine, working medium gases are compressed within the compressor section to pressure ratios on the order of thirty to one (30:1) and burned with fuel in the combustion section. The hot effluent from the combustion section is expanded through the turbine section to provide the motive force driving the compressor. Pressures across the compressor section of a typical engine increases at each succession stage from atmosphere pressure to the order of four hundred fifty pounds per square inch absolute (450 psia) at sea level take-off conditions. Correspondingly, temperatures across the compressor section increase at each succesive stage from ambient conditions to the order of eleven hundred fifty degrees Fahrenheit (1150° F.) at sea level take-off conditions. Corresponding temperatures at the inlet to the turbine section are on the order of twenty-five hundred degrees Fahrenheit (2500° F.). Radical variations in engine temperatures over the operating cycle of the engine establish the need for control of clearances between rotating and stationary structures under the influence of differing environments.

The concepts of the present invention employ case heating and case cooling in accord with the engine cycle to achieve close growth correspondence between the rotor and the case supported seals. Case temperature modifying air is utilized for such heating and cooling. The modifying air comprises varied proportions of heating and cooling air ducted from the engine compressor to the case segment to be cooled. Representative characteristics of case temperature modifying air produced as the effluent from a modulating and mixing valve, such as that described herein, is shown in the table reproduced below. The pressure, temperature and flow rate data is representative of a forty thousand (40,000) pound thrust class engine at idle, sea level take-off and cruise conditions. Data is for a split-type system in which a first modulating valve is supplied with dual source air for discharge and temperature control of the high pressure turbine case and a second modulating valve is supplied with dual source air for discharge and temperature control of the low pressure turbine case.

| | | Low Pressure Low Temperature Source | High Pressure High Temperature Source | High Turbine Modifying Air |
|---|---|---|---|---|
| | | HIGH PRESSURE TURBINE | | |
| Idle | Pressure | 27 psia | 61 psia | 25 psia |
| | Temp | 290° F. | 430° F. | 430° F. |
| | Flow Rate | 0.0 lb m/sec | .06 lb m/sec | .06 lb m/sec |
| Sea Level Take-off | Pressure | 136 psia | 431 psia | 130 psia |
| | Temp | 720° F. | 1110° F. | 970° F. |
| | Flow Rate | .10 lb m/sec | .22 lb m/sec | .32 lb m/sec |
| Cruise | Pressure | 65 psia | 197 psia | 60 psia |
| | Temp | 580° F. | 900° F. | 580° F. |
| | Flow Rate | .155 lb m/sec | 0.0 lb m/sec | .155 lb m/sec |
| | | LOW PRESSURE TURBINE | | |
| Idle | Pressure | 20 psia | 61 psia | 0 |
| | Temp | 220° F. | 430° F. | 0 |
| | Flow Rate | 0.0 lb m/sec | 0.0 lb m/sec | 0 |
| Sea Level Take-off | Pressure | 75.0 psia | 431 psia | 62 psia |
| | Temp | 580° F. | 1110° F. | 820° F. |
| | Flow Rate | .642 lb m/sec | .526 lb m/sec | 1.168 lb m/sec |
| Cruise | Pressure | 33 psia | 197 psia | 28 psia |
| | Temp | 420° F. | 900° F. | 420° F. |
| | Flow Rate | .56 lb m/sec | 0.0 lb m/sec | .56 lb m/sec |

Each of the one or more modulating valves is controllable in response to engine operating conditions to produce the effluents described above. The modulating valves are controllable in response to engine operating conditions. Parameters representative of engine condition, such as case temperature, rotor speed, engine pressure rates, altitude Mach Number, turbine temperature and exhaust gas temperature are selected for control. For the representative engine described above the parameters shaft RPM, altitude, and flight Mach Number were selected for control.

| | Low Rotor Speed | High Rotor Speed | Altitude | Flight Mach Number |
|---|---|---|---|---|
| Ground Idle | 1115 RPM | 10,063 RPM | 0 ft. | 0.0 |
| Sea Level Take Off | 3923 RPM | 14,045 RPM | 0 ft. | 0.0 |
| Cruise | 3902 RPM | 13,178 RPM | 35,000 ft. | .80 |

Referring again to the FIG. 4 "pinch point" diagram curve C represents the radial position of an outer air seal as it is varied over the engine operating range by modifying the supporting case in accordance with the present concepts in accordance with the sensed parameters, shaft RPM, altitude and flight Mach Number. The gap Y represents the attainable relative clearance between the tips of the rotor blades and the corresponding outer air seal. Clearance is not only greatly reduced from the non-controlled conditions, but closely corresponds in contour to the radial position of the tips. The minimum clearance necessary to avoid destructive interferences is provided.

Although the invention has been described with respect to a particular turbine embodiment, it should be understood that the invention is not so limited and that various changes and modifications may be made without departing from the spirit and scope of this novel concept.

We claim:

1. A method of controlling the clearance between opposing seal elements of the rotor assembly and the stator assembly including supporting structure of a dual rotor gas turbine engine having high pressure compressor and high pressure turbine, low compressor and high pressure turbine rotors comprising the steps of:

flowing relatively low pressure, low temperature air from the compressor of the engine to a modulating and mixing valve;

flowing relatively high pressure, high temperature air from the compressor of the engine to said modulating and mixing valve;

mixing said relatively low pressure, low temperature air and said relatively high pressure, high temperature air at the modulating valve in proportions functionally related to engine operating condition to produce a mixture of air having a desired temperature, pressure and flow rate at that operating condition for thermally modifying the diameter of the turbine case adjacent said high pressure turbine;

flowing said mixed air to the high pressure turbine section of the engine and against the case thereof for thermally varying the diameter of said case to achieve control over clearances between the rotor and stator assemblies of said high pressure turbine and admitting the effluent mixed air from said case internally thereof so as to cool said supporting structure;

flowing relatively low pressure, low temperature air from the compressor of the engine to a second modulating and mixing valve;

flowing relatively high pressure, high temperature air from the compressor of the engine to said second modulating and mixing valve;

mixing said relatively low pressure, low temperature air and said relatively high pressure, high temperature air at the second modulating valve in proportions functionally related to engine operating condition to produce a mixture of air having a desired temperature, pressure and flow rate at that operating condition for thermally modifying the diameter of the turbine case; and flowing said air mixed at the second modulating valve to the case of the low pressure turbine at a location downstream of the location to which the air mixed at the first modulating valve was flowed and against the case at that downstream location for thermally varying the diameter of the case at that location.

* * * * *